United States Patent [19]

Peyser

[11] 4,344,238

[45] Aug. 17, 1982

[54] MULTI-PURPOSE CRAMPON

[76] Inventor: Leonard F. Peyser, Old Sleepy Hollow Rd., Briarcliff Manor, N.Y. 10510

[21] Appl. No.: 169,105

[22] Filed: Jul. 15, 1980

[51] Int. Cl.[3] ..... A43B 3/10; A43C 15/00

[52] U.S. Cl. ..... 36/7.6; 36/62

[58] Field of Search ..... 36/7.6, 62

[56] References Cited

U.S. PATENT DOCUMENTS 1,506,662 8/1924 Peller ..... 36/7.6

2,399,638 5/1946 Kalmitz ..... 36/7.6

3,095,657 7/1963 Fradette ..... 36/7.6

3,229,389 1/1966 Adams ..... 36/7.6

*Primary Examiner*—Patrick D. Lawson

*Attorney, Agent, or Firm*—Kenneth H. Murray; Warren N. Low

[57] ABSTRACT

An improved light weight crampon for ready attachment to shoes and boots as an ice creeper or the like having rugged construction and versatility of adjustment.

12 Claims, 7 Drawing Figures

MULTI-PURPOSE CRAMPON

BACKGROUND OF THE INVENTION

Patent art pertaining to crampon attachments to boots or shoes or ice creeper devices has developed in recent years with increased interest in outdoor activities as hiking, rock climbing, and mountaineering, especially in wintertime under ice or packed snow conditions.

In order to be effective, such creeper or crampon devices must be readily attachable to a boot or shoe, be securely fastened thereto so as to preclude looseness or slippage which could be quite hazardous to the wearer, be sturdy enough to withstand the punishment of the terrain to which to creepers are subjected and be readily adjustable for differing shapes of boots or sole configurations.

Diverse efforts to produce crampons of this type have led to inordinately complex, unduly heavy, or expensive structures which have not been particularly practical or reliable in service. There is, therefore, a need for sturdy, reliable multi-utility crampons that can be provided at a reasonable price.

SUMMARY OF THE INVENTION

The present invention uniquely provides a crampon or creeper attachment for hiking shoes and boots of highly simple construction yet having rugged reliability.

The effectiveness thereof has been tested by actual use and is the fruitful result of numerous prior forms and designs that have been fabricated and subjected to experiment.

Briefly stated, the instant invention is characterized by a crampon having a pair of identical separate sole and heel toothed plates of hardened carbon steel, although other materials may be suitable, and which are interconnected by a flexible sole strap and which latter is adjustably connected to the plates to variably predetermine the length thereof depending upon the wearer's footgear.

Further, the sole plate includes securing means for detachably and adjustably attaching the forward plate to the toe portion of the boot, while the heel plate includes strap-like means extending therefrom to either side of the heel and which interconnect with a further strap lying across the instep of the foot or boot. A short heel strap completes the assembly and the instep, heel strap, and heel plate interconnecting strap are readily adjustable for comfort and fit with respect to the boot or shoe.

In addition, all of the securing and interconnecting straps are provided with ready adjustment principally by means of keyhole slots in the straps and headed pins fixedly secured to the heel and sole plates permitting a totality of adjustment to accommodate all probable footwear configurations.

Finally, the several interconnecting and securing straps are preferably formed from an extremely rugged material as a neoprene and nylon laminate which provides a certain amount of yieldability while the tensile strength of the nylon provides substantial durability.

BRIEF DESCRIPTION OF THE DRAWINGS

The invention shall be better understood when taken in connection with the accompanying drawings in which.

DESCRIPTION OF THE PREFERRED EMBODIMENT

With reference to the drawings, the improved and versatile crampon assembly 10 of the present invention is seen in operative position as attached to an illustrative hiking boot or shoe 12 of usual high top form and having a sole 14 of substantial thickness with a usual lugged tread of conventional form.

Figure 3:
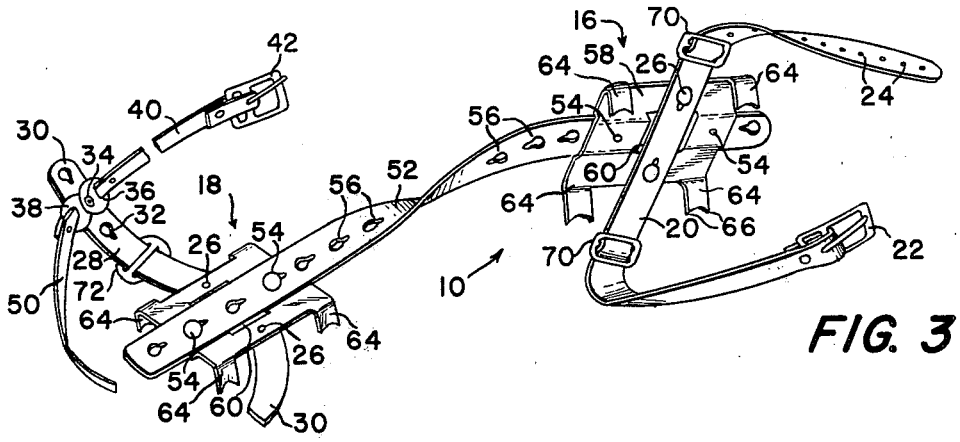
FIG. 3 is a perspective view of the entire crampon assembly illustrating the mode of connection of the several securing means and straps, portions thereof being broken away.
Figure 4:
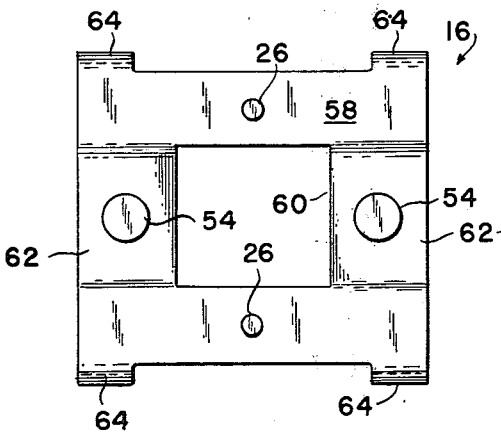
FIG. 4 is a top plan view of the heel and sole plates.
Figure 5:
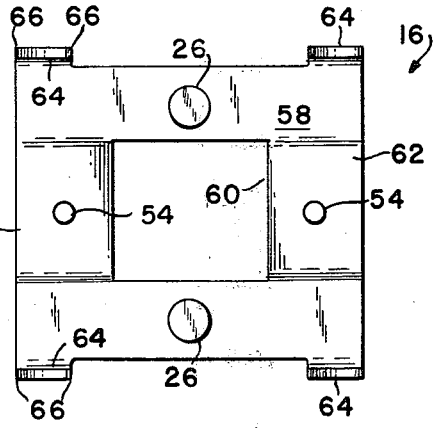
FIG. 5 is a bottom plan view thereof.
Figure 6:
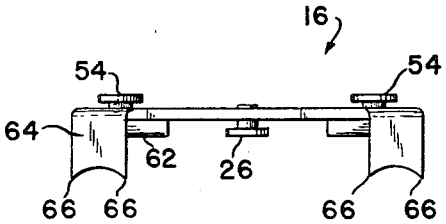
FIG. 6 is a side view of the plate of FIGS. 4 and 5.

The overall assembly is best seen in FIG. 3 as detached from a shoe but ready for association therewith and the same includes a forward sole plate 16 and a substantially identical rear heel plate 18. Detachably associated with sole plate 16 is a securing means 20 which is preferably a flexible strap having a usual buckle 22 at one end while the other end of strap 20 includes a conventional series of perforations 24 for cooperation with the buckle 22. The strap 20 is detachably associated with toe plate 16 by means of headed rivets 26.

The rear heel plate 18 includes an interconnecting means such as a strap 28 which extends laterally to either side of rear plate 18 and terminates at each terminal end 30 in a series of spaced adjustment apertures 32. The apertures 32 are of generally keyhole or like relatively tapered configurations for cooperation at each end with a headed rivet 34 which serves as a pivotal connection for a pair of overlapping discs 36, 38. The forward discs 36 are respectively slotted for reception therethrough respectively of forwardly extending securing means as a buckle strap 40 on one side terminating in a usual buckle 42 and a cooperating length of strap 44 on the other side having perforations 48 therein for cooperation with the buckle.

The rearward disc 38 on each rivet 34 is similarly slotted to receive an ankle strap length 50 extending between the discs 38 and is provided with a like buckle assembly, not shown, whereby the same may be readily adjustably secured about the heel portion of the boot 12.

The sole and heel plate 16, 18 are respectively connected together by means of a strap 52 which is detachably connected to a series of headed rivets 54 on the upper surfaces of the forward and rear plates 15, 18 by virtue of a similar series of appropriately spaced and positioned keyhole apertures 56 in strap 52.

Figure 1:
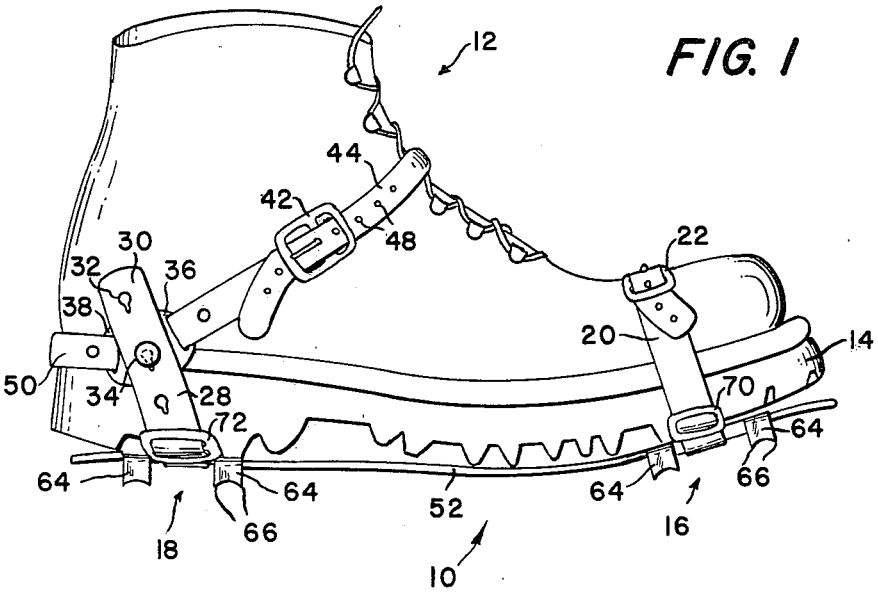
FIG. 1 is a side elevation of the multi-use crampon of the invention as attached to an illustrative hiking shoe.
Figure 2:
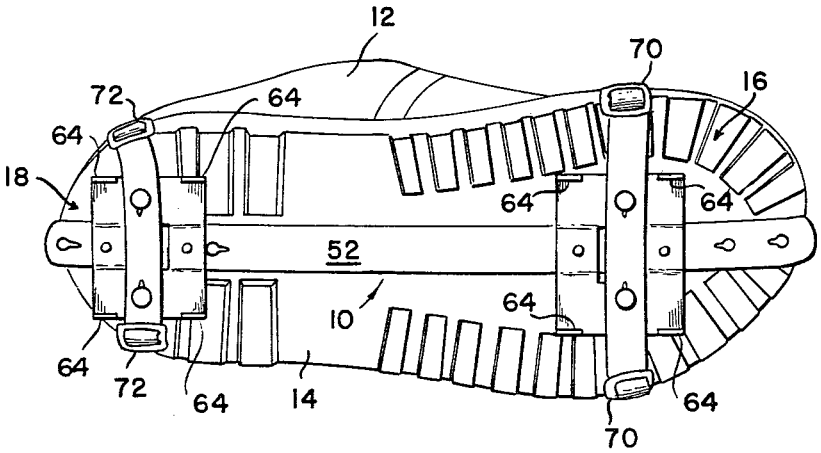
FIG. 2 is a bottom perspective view of the crampon of the invention on the shoe of FIG. 1.

As seen in FIGS. 1 and 3, there are provided adjusting slides 70 and 72 on the strap portions at either side of the front sole plate 16 and rear heel plate 18. The slides are of conventional "FIG. 8" form and are gently curved in cross section, whereby the strap portion passing therethrough tend to deflect or bend upwardly from the sole in FIG. 1.

Further, forwards slides 70 are of generally rectangular contour, while the rear slides 72 have a somewhat parallelogram configuration. This latter form facilitates the rearward angling of the strap as seen in FIG. 1.

With greater reference to FIGS. 4–7, and wherein the similar toe and heel plates 16, 18 are shown in more detail, the forward or sole plate 16 is identified therein. It will be appreciated that the structure is identical for heel plate 18.

Figure 7:
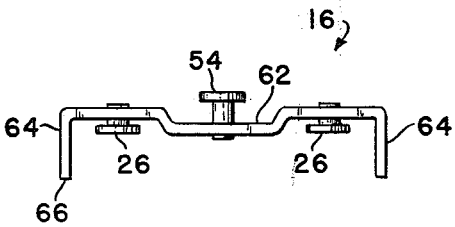
FIG. 7 is an end view of the plate.

Plate 16 is an integral one piece construction and preferably formed from hardened carbon steel to withstand the abuse encountered in traversing rocky and uneven terrain. To that end, the plate 16 includes a generally planar central section 58 and is provided with a large central aperture 60. The central portion 58 is offset longitudinally along the centerline thereof at 62 to form a shallow groove as best seen in FIGS. 3 and 7 within which is received fore and aft ends of sole strap 52. Centrally of the groove area 62 on either side of aperture 60, headed rivets 54 are provided and which interconnect with the keyhole slots 56 of strap 52 as seen in FIG. 3.

Similarly, like headed rivets 26 facing in the opposite direction or toward the lower side of plate 16 are provided as above noted and with similarly interlock with the forward securing strap 20 as seen in FIG. 3 in like manner. Similarly, the plate 18 has comparable rivets 26 which detachably connect to the upwardly extending ankle strap portions 28, 30.

Finally, and most importantly, the plate 16 includes at its corners integrally formed and downturned gripper points 64 which extend substantially perpendicularly to the central portion 58 of the plate 16 and in the illustrated embodiment lies substantially in parallel alignment. In a preferred form of the invention, the gripper point 64 terminate in spaced barbs 66 separated by an arcuate or concavely cut area.

Improved crampons or versatile creepers of the present invention as thus described possess all of the desirable characteristics above noted. As the construction thereof includes the relatively small but highly effective sole and heel plate 16, 18 of hardened, tempered high-carbon steel, while the remainder thereof consists principally of the nylon-reinforced neoprene strapping in the preferred form with conventional stainless steel buckles and thin brass or like pivot discs at 36, 38, it will be seen that the entirety is quite light and can be readily folded or carried when not in use.

In actual construction and use of the device of the invention, a total weight of 12 ounces per pair is achieved or only about 6 ounces per boot. When not in use, it will be seen that the sole and heel plate 16, 18 can be folded toward each other and the confronting plates can be generally wrapped with the strapping, and the entirety readily placed into a jacket pocket or into a portable pouch or stuffsack.

In fitting the crampons onto the boots, the same is preferably achieved while the boots are removed, although it is certainly possible to apply the same while the boot is on the foot.

With the shoe or boot removed, the same is preferably held upside down and the rear heel plate 18 after assembly with the strapping is placed against the center of the heel and the forward plate 16 is then adjusted with respect thereto by virtue of the rivets 54 and keyhole slots 56 so that the forward plate is spaced rearwardly of the boot toe on the order of perhaps two inches so as to generally locate the forward securing strap 20 slightly forwardly of the widest portion of the sole area.

The adjusting slide 70 located on either side of the forward plate 16 and the similar parallelogram-shaped adjusting slide 72 on the rear ankle straps are then positioned so as to be disposed substantially adjacent the edges of the sole and the heel.

In this manner, the slide pieces provide corner strength and rigidity to the strap and tend to angle the same upwardly toward the toe and heel respectively for ready handling.

By virtue of the pivot pin 34 and the disc 36, 38, a comfortable angle can be achieved with respect to the strap 28 and the instep strap 40 as well as the heel strap 50. In this regard, it is considered preferable to have a relative low point of attachment of rivet 34 to strap 28 in one of the relatively lower keyhole apertures 32, depending of course upon the nature of the boot or shoe with which the same is associated. In like manner, the heel strap 50 is preferably closely adjacent the rear of the heel at a minimum height which is a function of its concomitant location with rivet 34.

The result of this construction as applied to the boot is highly effective and by virtue of the neoprene-nylon preferred strap, ice and snow does not readily adhere thereto so as to preclude difficult handling of the straps in icy areas.

Normal hiking may thus be enjoyed over diverse terrain wherein the barbs at 66 will bite readily into normally slick surfaces as glazed ice while additionally enhancing bite into packed snow and irregular terrain generally.

While in the illustrated embodiment I have shown the gripper points or teeth 64 as extending substantially parallel to the longitudinal axis of the boot, in certain instances or under particular terrain conditions it may be preferable to rotate the sole and heel plates 16, 18 through 90° so as to dispose the teeth 64 transverse to the line of travel, thereby forming, in effect, four parallel rows of teeth fore to aft.

It will be seen that plates 16, 18 can be readily so turned, and the several straps reconnected as desired to the headed pins 26, 54.

While it is within the scope of my invention to employ other and different materials as hard plastics or other metals for the forward and rear plate 16, 18, such altered materials are subject to more rapid wear and I have found that tempered steel as set forth is highly effective wherein the creeper points and barbs show substantially greater endurance.

Likewise, leather or other materials might be substituted for the nylon-neoprene strap while otherwise achieving the advantages of my invention, but the desirability and effectiveness of the preferred material will be lost.

The combination of elements as set forth cooperate to provide a highly effective light weight crampon or creeper as to which I claim inventive novelty as set forth in the appended claims.

I claim:

1. A multi purpose crampon for detachable securement to hiking boots or the like, comprising, respective sole and heel creeper plates, each of said plates having a substantially planar upper surface to permit desired positioning thereof beneath a boot sole and heel, and a plurality of gripper points extending from the lower surface thereof, flexible sole strap means interconnecting said sole and heel plates, toe securing means including a flexible strap extending from said sole plate to secure the sole plate to a toe portion of a boot, heel securing means including a flexible strap extending from either side of said heel plate, slide members adjustably connected to said straps on either side of both said toe plate and heel plate, means interconnecting end portions of said heel securing means for extending forwardly to overly the instep portion of a boot, and, further means interconnecting said end portions for extending rearwardly around the heel portion of a boot, said instep and heel interconnecting means thereby together securing said heel plate to a boot, whereby said sole and heel plates may be positioned with respect to a given boot, and the said slide members adjusted with respect to the respective straps to an adjacent edge portion of the boot, and the several straps means and securing means connected thereby to secure the crampon with respect to any given hiking boot or the like to impart traction thereto in hiking.

2. The crampon of claim 1 wherein all said straps are fiber reinforced rubber.

3. The crampon of claims 1 or 2 wherein said heel and sole plates comprise steel.

4. The crampon of claim 3 wherein said steel is tempered and hardened carbon steel.

5. The crampon of claim 3 wherein said plate gripper points are integrally formed with said central portion.

6. The crampon of claims 1 or 2 wherein said securing means and said sole strap have detachable connections to said plates.

7. The crampon of claim 6 wherein said detachable connections include pins on said plates and a spaced series of cooperating apertures on said securing means and sole strap for selective association with said pins.

8. The crampon of claim 7 wherein said pins include a pair of pins in spaced longitudinal relation to each other and a second pair of pins in substantially similarly spaced transverse relations on said plates.

9. The crampon of claim 8 wherein one said pair of pins extends outwardly on one side of said plate and the other said pair extends outwardly on the other side of said plate.

10. The crampon of claim 3 wherein said gripper points are each provided with two spaced barbs.

11. The crampon of claim 3 wherein said plates include a central aperture, and a shallow indented groove extending in opposite directions from said aperture to receive a strap therein.

12. The crampon of claims 1 or 3 further including a a pivot connection between said heel securing means, said instep interconnecting means, and said heel portion interconnecting means, thereby to adjust the angle therebetween with respect to the heel, instep, and heel plate.

* * * * *